United States Patent [19]

Marschak

[11] 4,322,006

[45] Mar. 30, 1982

[54] DISPLAY UNIT MOUNTING MEANS

[76] Inventor: Howard J. Marschak, 865 W. North Ave., Chicago, Ill. 60622

[21] Appl. No.: 111,593

[22] Filed: Jan. 14, 1980

[51] Int. Cl.[3] ..... A47F 3/06

[52] U.S. Cl. ..... 211/88; 211/126; 248/221.1

[58] Field of Search ..... 211/88, 126; 248/221.1, 248/221.2, 220.4

[56] References Cited

U.S. PATENT DOCUMENTS

| | | | |
|---|---|---|---|
| 3,860,309 | 1/1975 | Brendgord | 211/88 |
| 4,151,917 | 5/1979 | Pagh | 211/126 |
| 4,154,356 | 5/1979 | Schieve | 211/88 |
| 4,155,459 | 5/1979 | Marschak | 248/220.4 |
| 4,228,906 | 10/1980 | Jores | 211/126 |

*Primary Examiner*—William F. Pate, III

*Attorney, Agent, or Firm*—Dithmar, Stotland, Stratman & Levy

[57] ABSTRACT

A display unit used with an apertured support for displaying a plurality of objects with two fixtures each having a body portion with top and bottom edges and two spaced engagement prongs extending outwardly from the body portion at junctures spaced inwardly from the top edge and in use extending through apertures in the apertured support to mount the fixture thereto, a spacer extending from the body portion of each of the fixtures for maintaining each fixture a predetermined distance from the apertured support, a container having upstanding front, rear and side walls connected by a bottom, and mounting means on at least one of the front and rear walls including a lip generally parallel to and spaced from the associated wall defining a dome-shaped channel therebetween with spaced notches in the lip to ensure contact between the associated fixture top edge and the channel top surface and dome-shaped braces in the channel bracketing each notch to provide strength to the mounting means, the bottom edge of each fixture bearing against the associated container wall providing a wedging action.

11 Claims, 4 Drawing Figures

DISPLAY UNIT MOUNTING MEANS

BACKGROUND OF THE INVENTION

Display units used to display and illustrate merchandise must be inexpensive yet of relatively sturdy construction in order that a great many of the display units can be used while at the same time withstanding severe abuse so that the displayed commodities are retained in a predetermined display relationship. An additional requirement for display units is that they have a capacity sufficiently large to permit sufficient numbers of the unit to be shown at one time so that the store management does not continually have to replenish the supply of its displayed articles. Stocking and restocking problems are alleviated by having a large capacity display unit. On the other hand, when the display units become too large, often they become subject to unwanted flex and/or sway problems thereby resulting in accidental tipping or tilting which is undesirable.

Prior art display units which are available generally have one or more of the above mentioned problems, that is capacity which is small so that frequent restocking is required or alternatively larger capacity, but a flimsy construction so that the displayed merchandise is often bumped or jostled from the display.

A prior art device described and claimed in my prior U.S. Pat. No. 4,155,459 issued May 22, 1979 discloses a display unit which obviates the foregoing problems and in addition provides an automatic feed of the displayed item to the front of the display unit when the customers remove items for purchase. However, the nature of the mounting mechanism of the device disclosed in the aforementioned patent is such that it is difficult to mount side-by-side display units.

The subject invention obviates all the problems of the prior art discussed with respect to stocking and restocking problems, flimsy construction as well as insufficient storage capacity and also solves the problem of difficulty in mounting side-by-side display units on the fixtures described and claimed in the aforementioned U.S. patent.

BRIEF SUMMARY OF INVENTION

This invention relates to a display unit in which a pair of fixtures mounted to an apertured board serve to interconnect a display container to the apertured board, and more particularly, this invention pertains to a unique combination of container and fixtures which results in a rigid construction with a sufficiently large capacity to prevent frequent restocking while at the same time allowing easy removal of the display unit from the fixtures even where the display units are in side-by-side relationship.

The principal object of the present invention is to provide a display unit used with an apertured support for displaying a plurality of objects, comprising two fixtures each having a body portion with top and bottom edges and two spaced engagement prongs extending outwardly from the body portion with the junctures thereof spaced inwardly from the top edge and in use extending through apertures in the apertured support to mount the fixture thereto, a spacer extending from the body portion of each fixture for maintaining each fixture a predetermined distance from the apertured support, a container having upstanding front, rear and side walls connected by a bottom and mounting means on at least one of the front and rear walls including a lip generally parallel to and spaced from the associated wall defining a channel therebetween, each of the channels being of a dimension to receive therein the body portion of a fixture between the top edge thereof and the junctures of the engagement prongs, the bottom edge of each fixture bearing against the associated container wall.

Another object of the present invention is to provide a display unit of the type set forth wherein each fixture has an upstanding portion between the engagement prongs which fits within the channel, the upstanding portion having a top edge in contact with the top of the channel when the container is mounted on the fixtures.

A further object of the present invention is to provide a display unit of the type set forth wherein the lip extends from container side wall to container side wall and has braces intermediate the side walls, the channel formed by the lip and associated wall in transverse cross section is dome-shaped and the lip has spaced notches therein to ensure contact between the associated fixture top edge and the channel top surface and braces in the channel bracket each notch providing strength to the mounting means.

These and other objects of the present invention may be more readily understood when taken in conjunction with the following specification and drawings, in which;

DESCRIPTION OF THE PREFERRED EMBODIMENT

Figures 1, 2, 3, 4:
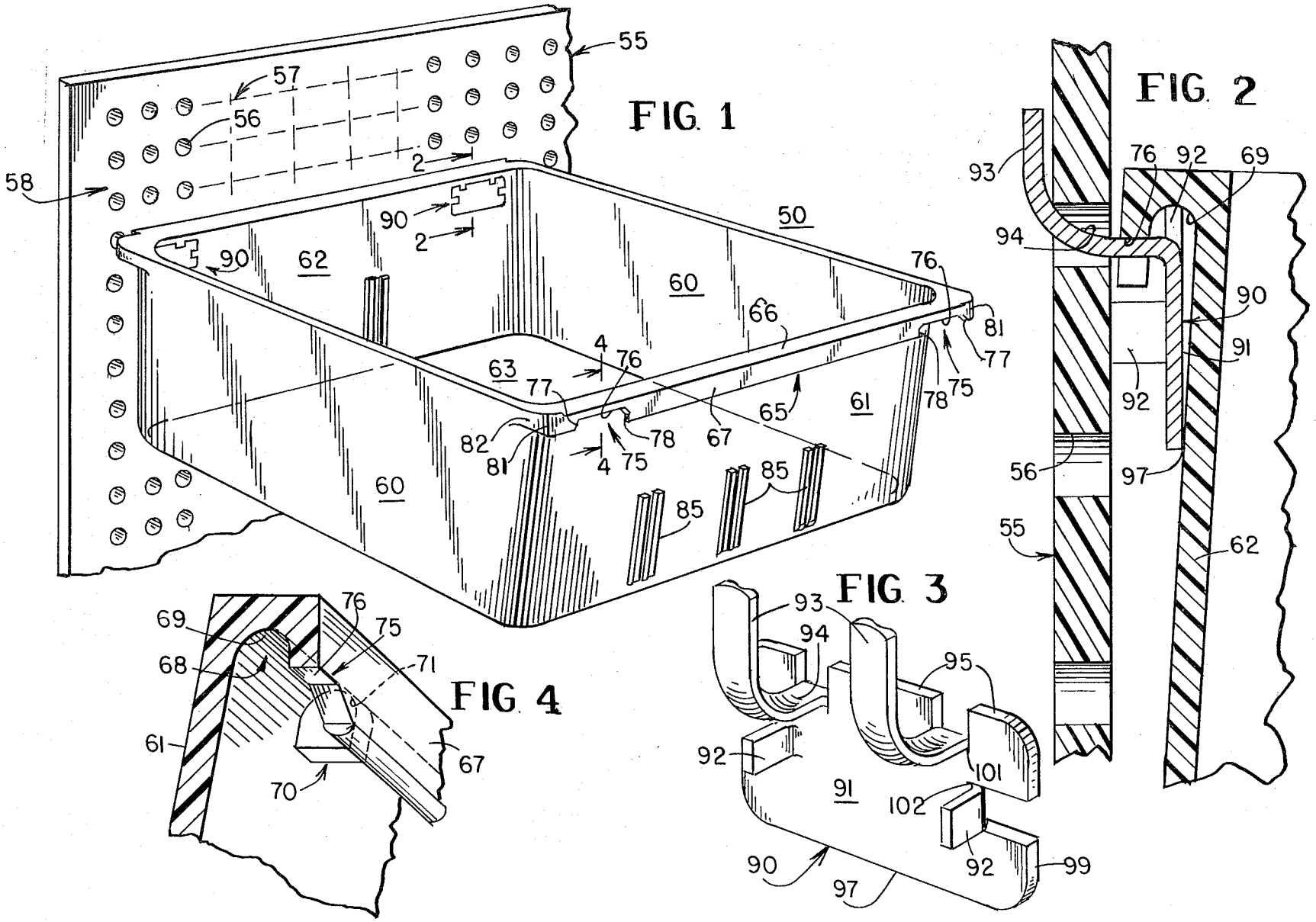
FIG. 1 is a perspective view of the display unit of the present invention shown mounted to an associated apertured support.
FIG. 2 is a view in section of the display unit illustrated in FIG. 1 as viewed along line 2—2 thereof.
FIG. 3 is an enlarged perspective view of a fixture used in the display unit of the present invention.
FIG. 4 is an enlarged perspective view partly in section of the mounting means illustrated in FIG. 1 as viewed from the direction of line 4—4 thereof.

Referring to the drawings, there is disclosed a container 50 mounted to an apertured board or support 55 by means of spaced apart fixtures 90. The apertured support 55 may be of any suitable material such as fiberboard, particle board or the like provided with apertures 56 arranged in rows 57 and columns 58. The container 50 includes two spaced apart and generally parallel side walls 60 interconnected by an inwardly inclining front wall 61 and an inwardly inclining rear wall 62, the side wall, front wall and rear wall being interconnected by an integral bottom 63. Preferably, the container 50 is a unitary piece of transparent synthetic organic resin molded in a single operation.

Provided on both the front wall 61 and the rear wall 62 are mounting means 65, but it is apparent that only one of the front wall or the rear wall need be so provided. Since the mounting means 65 on the front wall 61 is identical to the mounting means on the rear wall 62 only one will be described in detail, for the sake of brevity.

The mounting means 65 includes a horizontally extending lip 66 interconnected to a vertically extending lip 67, the junctures between the lip 66 and the lip 67 forming an angle of approximately 90° with the two lips 66 and 67 defining a channel or locking area 68 between the adjacent container wall, that is either front wall 61 or rear wall 62, and the inside of the downwardly or vertically extending lip 67. This channel or locking area 68 is dome-shaped in transverse cross section (see FIG. 4) and has a rounded or curved top surface 69, the channel or locking area 68 extending substantially from side wall 60 to side wall 60.

Spaced apart notches 75 are formed in the downwardly extending lip 67 and are bracketed on either side thereof by a pair of braces 70, the braces 70 being dome-shaped and interconnecting the vertically extending lip 67 with the adjacent container wall, that being either the front wall 61 or the rear wall 62. The dome-shaped braces 70 each of which as before stated have a rounded top 71 which is complementary in shape to the inside surface 69 of the channel 68 has a vertical extent slightly less than the vertical extent of the lip 67 to ensure that the brace 70 does not extend below the lip 67 and be unsightly.

The mounting notches 75, two of which are formed in each vertical lip 67, includes a horizontal flight 76 terminating at each end in a obliquely downwardly slanting flight 77 which in turn terminates in a small vertical flight 78. Preferably, the horizontal flight 76 of each notch 75 is at substantially the vertical midpoint of each lip 67, but the exact vertical position of the notches 75 is not critical. Intermediate each of the notches 75 the vertical extent of the lip 67 is somewhat greater than the vertical extent of the lip 67 between each notch 75 and the adjacent side wall 60. This feature is for strength.

Additionally, the sections 81 of the lip 67, that is the portion of the lip 67 extending outwardly from each notch 75 to the adjacent side wall 60 is positioned closer to the adjacent container front wall 61 or rear wall 62, as the case may be, and meets an extension 82 of the side wall 60 beyond the juncture of the side wall 60 and the adjacent front wall 61 or rear wall 62. The portions 81 are recessed or set closer to the adjacent front wall 61 or rear wall 62 in order to compensate for metal framing of the apertured supports 55 when one of the containers 50 is positioned adjacent the end of the apertured support 55 and could contact the metal framing member (not shown).

Finally, there are illustrated three pair of spaced apart tracks 85 positioned in the front wall 61 and the rear wall 62, these tracks 85 being provided to support partitions (not shown) which may divide the container 50 into a plurality of separate bins or compartments. As illustrated, both the front wall 61 and rear wall 62 incline inwardly, that is toward each other, with the front wall inclining at an angle of approximately 15° to a plane perpendicular to the bottom 63, the intersection of that reference plane with the bottom 63 forming a line parallel to the intersection of the front wall 61 with the bottom 63. The rear wall 62 inclines at an angle of approximately 3 to 3½°, as defined by a similarly placed reference plane.

The fixtures 90, particularly as shown in FIG. 3, are identical and each has a flat body 91 and two spaced apart spacer prongs 92 extending away from the body 91 at approximately right angles thereto at the junctures 102. Two spaced apart engagement prongs 93 each having a horizontal portion 94 extend away from the body 91, again as substantially right angles thereto, at the junctures 101, each prong 93 have an upstanding portion which in use extends behind the associated apertured support 55. The fixtures 90 and particularly the body portions 91 thereof each have a top edge 95, a bottom edge 97 and side edges 99. The spacer prongs 92 extend away from the body 91 at a position inwardly of the adjacent side edges 91 and similarly the engagement prongs 93 extend away from the body 91 at positions inwardly of the adjacent top edge 95, the portion between the engagement prongs 93 forming an upstanding center ledge 98, see FIG. 2.

As particularly illustrated in FIG. 2, when the container 50 is mounted on spaced apart fixtures 90, the center ledge 98 is in contact with the surface 69 of the channel 68 and the bottom edge 97 of each fixture 90 is in contact with the associated front wall 61 or rear wall 62 of the container 50. The coaction of the fixture edge 97 and the engagement prongs 93 extending through associated apertures 56 in the apertured support 55 causes a wedging action of the upstanding ledge 98 of each fixture in the channel 68. This wedging action provides a secure mount of the container 50 to the fixtures 90 to the apertured support 55 in contradistinction to many of the prior art devices. On the other hand, the wedging action is achieved by mounting the container 50 in a vertical direction onto the premounted fixtures 90, obviating the difficulties of the side mounting necessary for the container illustrated in my prior mentioned U.S. Pat. No. 4,155,459. This is a critical distinction where containers are mounted in side-by-side relation that permits easy substitution of containers 50 in a manner not previously available.

Where there has been illustrated a container 50 which has both the front wall 61 and the rear wall 62 inwardly slanted at angles from about 3° to about 15°, it is apparent that only one wall need be angled, that being the wall adjacent to the apertured support 55. Similarly, the material from which the container 50 is constructed is preferably a synthetic organic resin which is transparent, this is to facilitate display of articles. If storage is of principal importance rather than display, then clearly the synthetic organic resin need not be transparent. It is also possible to form the container 50 out of metal, but a synthetic organic resin is preferred since it is cheaper to construct; however, economics may change in the furture and the invention herein is intended to apply to containers of any suitable material.

While there has been described what at present is considered to be the preferred embodiment of the present invention, it will be appreciated that various modifications and alterations may be made therein without departing from the true spirit and scope of the present invention, and it is intended to cover in the claims appended hereto all such modifications and alterations.

What is claimed is:

1. A display unit used with an apertured support for displaying a plurality of objects, comprising two fixtures each having a body portion with top and bottom edges and two spaced engagement prongs extending outwardly from said body portion at junctures spaced inwardly from said top edge and in use extending through apertures in the apertured support to mount said fixture thereto, a spacer extending from the body portion of each of said fixtures for maintaining each fixture a predetermined distance from the apertured support, a container having upstanding front, rear and side walls connnected by a bottom, and mounting means on at least one of said front and rear walls including a lip generally parallel to and spaced from the associated wall defining a channel therebetween, each of said channels being of a dimension to receive therein the body portion of said fixture between the top edge thereof and the junctures of said engagement prongs, said mounting means having notches in the lip thereof to ensure the top edge of said upstanding portion contacts the channel top surface when said container is mounted on said fixtures, the bottom edge of each fixture bearing against the associated container wall.

2. The display unit set forth in claim 1, wherein said fixture has an upstanding portion between said engagement prongs, said upstanding portion fitting within said channel when said container is mounted on said fixtures.

3. The display unit set forth in claim 2, wherein the upstanding portion of each fixture has a top edge thereof in contact with the top of said channel when said container is mounted on said fixtures.

4. The display unit set forth in claim 1, wherein at least one of said container front and rear walls inclines inwardly toward the other wall.

5. The display unit set forth in claim 4, wherein both the front wall and the rear wall incline inwardly toward each other.

6. The display unit set forth in claim 4, wherein the incline of said front and rear walls is in the range of between about 3° and about 15° from a plane perpendicular to the container bottom.

7. The display unit set forth in claim 1, wherein said mounting means is on both said front wall and said rear wall.

8. The display unit set forth in claim 1, wherein said lip extends from container side wall to container side wall and has a brace intermediate said side walls.

9. The display unit set forth in claim 8, wherein said channel formed by said lip and the associated wall in transverse cross section is dome-shaped and said lip has spaced notches therein to ensure contact between the associated fixture top edge and the channel top surface and dome-shaped braces in said channel bracketing each notch provide strength to said mounting means.

10. The display unit set forth in claim 9, wherein said notches are spaced from the ends of said lip and the portions of said lip from said notches to the adjacent container side wall is closer to said front or rear container wall than the remainder of said lip.

11. The display unit set forth in claim 10, wherein the vertical extent of said lip between said notches exceeds the vertical extent of said lip between said notches and the adjacent container side wall.

* * * * *